US005697456A

United States Patent [19]

Radle et al.

[11] Patent Number: 5,697,456

[45] Date of Patent: Dec. 16, 1997

[54] POWER TOOL WITH VIBRATION ISOLATED HANDLE

[75] Inventors: Patrick J. Radle, Glendale; Jeffrey M. Zeiler, Pewaukee; Daryl S. Richards, Sussex, all of Wis.

[73] Assignee: Milwaukee Electric Tool Corp., Brookfield, Wis.

[21] Appl. No.: 419,753

[22] Filed: Apr. 10, 1995

[51] Int. Cl.[6] ..... B25D 17/00

[52] U.S. Cl. ..... 173/162.2

[58] Field of Search ..... 173/162.2, 162.1, 173/211

[56] References Cited

U.S. PATENT DOCUMENTS

| | | | |
|---|---|---|---|
| 1,358,486 | 11/1920 | Wilhelm | 173/162.2 |
| 1,597,245 | 8/1926 | Prellwitz | 173/162.2 |
| 2,290,256 | 7/1942 | Souter | 173/162.2 |
| 3,637,029 | 1/1972 | Sherwood et al. | 173/162 |
| 3,727,700 | 4/1973 | Amtsberg | 173/18 |
| 3,824,417 | 7/1974 | Moores, Jr. | 310/51 |
| 3,849,883 | 11/1974 | Kolorz | 30/381 |
| 3,968,843 | 7/1976 | Shotwell | 173/139 |
| 3,972,119 | 8/1976 | Bailey | 30/381 |
| 4,010,544 | 3/1977 | Siman | 30/381 |
| 4,138,812 | 2/1979 | Zimmerer et al. | 30/381 |
| 4,282,938 | 8/1981 | Minamidate | 173/162 H |
| 4,401,167 | 8/1983 | Sekizawa et al. | 173/162 H |
| 4,460,051 | 7/1984 | Widmer | 173/134 |
| 4,478,293 | 10/1984 | Weilenmann et al. | 173/162 R |
| 4,611,671 | 9/1986 | Hansson | 173/162 H |
| 4,614,241 | 9/1986 | Crover | 173/139 |
| 4,648,468 | 3/1987 | Honsa | 173/139 |
| 4,749,049 | 6/1988 | Greppmaier | 173/162 |
| 4,771,833 | 9/1988 | Honsa | 173/162.2 |
| 4,776,408 | 10/1988 | Elkin et al. | 173/139 |
| 4,819,742 | 4/1989 | Driggers | 173/162.2 |
| 4,825,548 | 5/1989 | Driggers | 30/276 |
| 4,905,772 | 3/1990 | Honsa et al. | 173/162.1 |
| 4,921,053 | 5/1990 | Dobry et al. | 173/162.2 |
| 5,025,870 | 6/1991 | Gantner | 173/162.2 |
| 5,027,910 | 7/1991 | Honsa et al. | 173/162.2 |
| 5,031,273 | 7/1991 | Yamaguchi | 16/116 R |
| 5,046,566 | 9/1991 | Dorner et al. | 173/162.002 |
| 5,052,500 | 10/1991 | Ohtsu | 173/162.002 |
| 5,054,562 | 10/1991 | Honsa et al. | 173/139 |
| 5,080,180 | 1/1992 | Hansson | 173/93 |
| 5,125,189 | 6/1992 | Holmin et al. | 51/170 R |
| 5,157,807 | 10/1992 | Keller et al. | 16/116 R |
| 5,269,381 | 12/1993 | Oscarsson | 173/162.2 |
| 5,368,107 | 11/1994 | Taomo | 173/162.2 |

FOREIGN PATENT DOCUMENTS

| | | | |
|---|---|---|---|
| 768976 | 10/1980 | U.S.S.R. | 173/162.2 |

*Primary Examiner*—Scott A. Smith
*Attorney, Agent, or Firm*—Michael, Best & Friedrich

[57] ABSTRACT

The invention provides a power tool including a tool body and a handle mounted on the tool body at an upper vibration isolation joint and a lower pivot joint. The lower joint permits pivotal movement of the handle relative to the tool body while giving an operator lateral stability and torsional control over the tool. The upper joint serves as a primary vibration isolation joint and includes a spring which is precompressed to a minor fractional portion of its unloaded length and which is positioned between the tool body and the handle to bias the tool body and the handle apart. The spring is compressible from its precompressed state responsive to operator applied pressure, and when operator applied pressure on the handle is maintained within predetermined levels the spring is operable to reduce transmission of vibration from the tool body to the handle during tool operation.

29 Claims, 3 Drawing Sheets

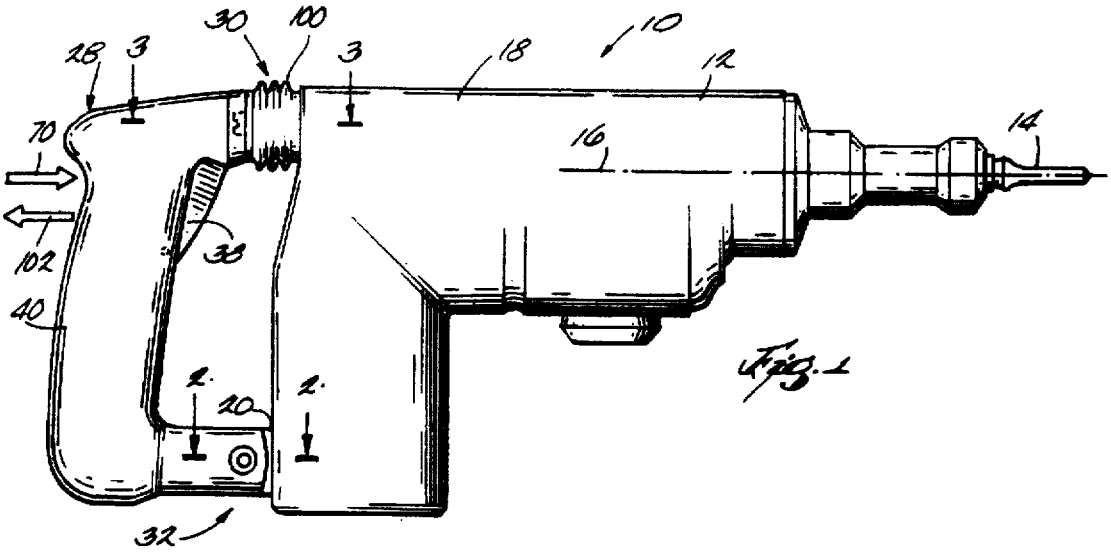
Fig. 1
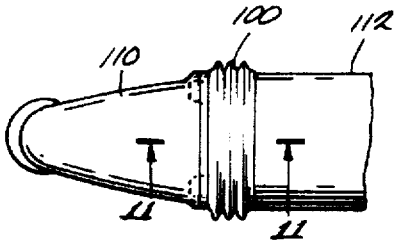
Fig. 10
Fig. 4
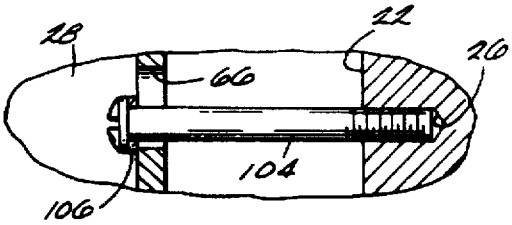
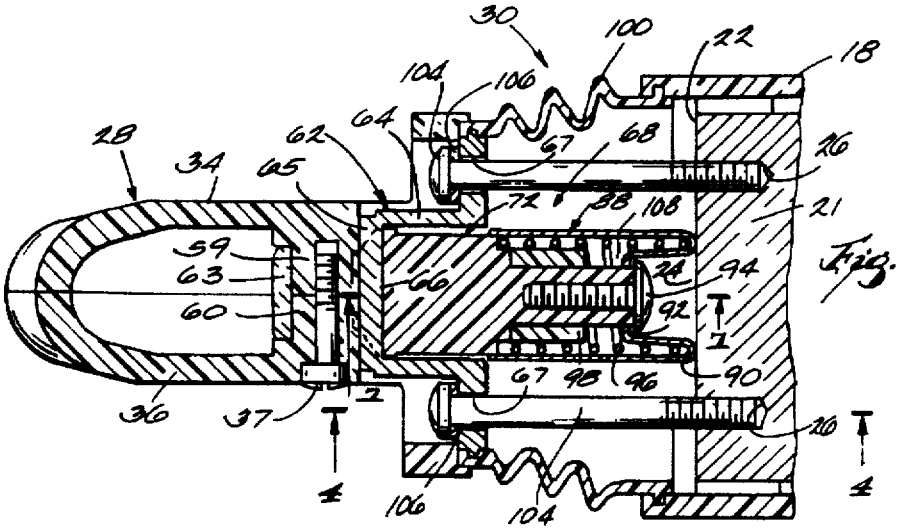
Fig. 3

POWER TOOL WITH VIBRATION ISOLATED HANDLE

BACKGROUND OF THE INVENTION

1. Field of the Invention

The invention relates generally to vibratory power tools, and more particularly to vibratory power tools including systems intended to reduce the transmission of vibration from the tool to the tool operator.

2. Reference to Prior Art

Various hand-held power tools such as rotary hammers or hammer drills, grinders and chain saws, for example, produce vibrations when in operation which are transmitted to the tool operator. Those vibrations can cause operator discomfort, and prolonged tool use and exposure to vibrations can result in operator fatigue, particularly in the hand and arm in which the tool is primarily held.

In an attempt to reduce vibration transmission from the tool to the tool operator, hand-held power tools have been provided with vibration damping or isolating systems positioned between the portion of the tool that generates the vibrations and the handle. Some of those tools employ elastomeric members which are compressed responsive to operator applied pressure on the tool handle and which are intended to absorb vibrations. For example, U.S. Pat. No. 4,749,049 illustrates a hammer drill having a handle that is mounted at two locations on the drill housing by a lower pivot spring-mounting and an upper spring-mounting, both including elastomeric vibration damping elements. Other hand-held power tools employing elastomeric damping elements positioned between the tool body and a handle are illustrated in U.S. Pat. Nos. 5,213,167, 5,052,500, 5,046,566, 4,401,167, 4,138,812 and 3,849,883.

It is also known to employ coil or other spring members at the tool body/handle interface in a vibratory power tool for the purpose of vibration absorption. Examples of such constructions are provided in U.S. Pat. No. 4,478,293 and the Makita Model HR3851 rotary hammer in which the handle is mounted on the tool via a leaf spring on one end and a pivot joint on the other end.

It is well accepted in the art that the various spring members used in vibration damping systems for hand-held power tools should be designed with high spring rates (or spring constants), i.e., considerable force is required to deflect the springs even a short distance. Softer spring members have been disfavored due to the large spring deflection required to provide adequate damping and the relative ease with which the spring, and therefore the tool handle, can be "bottomed out" when an operator applies excessive force on the handle. In the "bottomed out" condition, tool vibrations can be transferred directly to the operator as if no vibration damping element were employed at all. While the use of stiffer spring members reduces the chances that the tool will "bottom out" under operator applied loads, the use of those spring members also results in a higher transmissibility of tool vibration to the tool operator.

SUMMARY OF THE INVENTION

The invention provides a power tool, such as a hand-held rotary percussive tool, including an improved system for isolating a tool operator from vibrations generated during tool operation. The improved vibration isolation system is believed more capable of reducing the transmission of vibrations from the tool to the tool operator than are prior art vibration isolating arrangements, and the improved system is expected to provide vibration damping or isolation qualities that meet or exceed anticipated governmental standards relating to hand and arm vibration exposure. This is accomplished by incorporating a soft spring (i.e., a spring having a low spring rate) into the vibration isolation system, contrary to the teachings of the prior art.

In particular, the force, F, felt by a tool operator as a result of tool vibration is mathematically described as follows:

$$F=k\times d$$

where k=spring rate for the particular spring; and d=spring deflection resulting from vibration.

The use of a hard spring (i.e., a spring with a high spring rate, k) as taught by the prior art results in increased vibration transmission to the tool operator or increased tool mass to offset that transmission. Instead, Applicants have reduced k by employing a softer spring, thereby reducing the resulting force, F, felt by a tool operator, and have backed up the soft spring with a harder spring to prevent the tool from bottoming out.

In a preferred embodiment, the improved vibration isolation system includes a soft spring which is supported against buckling in a precompressed condition between the tool handle and the source of vibration. To prevent the handle from bottoming out, the soft spring is backed up by a harder spring which is engaged when the operator applied force on the handle exceeds a recommended level for normal power tool operation. The soft spring and the hard spring are assembled into a module which is self-contained and which is discardable at the end of its service life and easily replaceable with another module.

The invention also provides a power tool including a unique mechanism for indicating to a tool operator whether the level of operator applied pressure on the tool handle, and ultimately on the work medium, is within recommended levels. In particular, many manufacturers recommend that operator applied force be maintained within a prescribed range for optimum tool performance and efficiency. However, estimation of operator applied pressure is left to the subjective judgment of each operator. The present invention addresses that problem by providing a reliable control mechanism for objectively indicating to an operator the level of operator applied pressure exerted on the tool.

In a preferred embodiment of the invention the improved vibration isolation system incorporates the mechanism for indicating operator applied pressure levels, and that mechanism incorporates the precompressed soft spring. In particular, the soft spring is set so that the pressure needed to initially compress it beyond its precompressed condition is approximately the minimum recommended operator applied pressure level. Thus, the operator has a tactile indication that the minimum recommended operator applied pressure level is achieved when the soft spring is initially deflected from its precompressed condition. Additionally, the hard spring which backs up the soft spring is engaged when the soft spring reaches a compressed condition corresponding to a maximum preferred operator applied pressure level. Thus, the operator feels a substantially increased spring rate when operator applied pressure exceeds the recommended maximum level.

More particularly, in one embodiment the invention provides a power tool, such as a hand-held rotary percussive power tool, for example, including a tool body and a handle mounted on the tool body at an upper vibration isolation joint and a lower pivot joint. The lower joint permits pivotal movement of the handle relative to the tool body while providing lateral stability between the handle and the tool body so that an operator can exercise lateral and torsional control over the tool. The upper joint serves as a primary vibration isolation interface and includes a spring which is precompressed to a minor fractional portion of its unloaded length and which is positioned between the tool body and the handle to bias the tool body and the handle apart. The spring is compressible from its precompressed state responsive to operator applied pressure, and when operator applied pressure on the handle is maintained at a predetermined level (or within a range of levels) the spring is operable to reduce transmission of vibration from the tool body to the handle.

The invention also provides a vibratory tool including a tool body, a handle mounted on the tool body, and means for tactiley indicating to a tool operator when operator applied pressure on the handle is within a preferred range of operator applied pressure levels. The means for tactiley indicating to a tool operator when operator applied pressure on the handle is within the preferred range of operator applied pressure levels includes a spring positioned between the tool body and the handle. That means also preferably includes a stop member positioned in parallel with the spring. Deflection of the spring from its initial condition is felt by an operator to indicate when operator applied pressure has reached its minimum recommended level. When the operator applied pressure level reaches the maximum recommended pressure the stop member is engaged and this engagement is also felt by an operator.

Other features and advantages of the invention will become apparent to those skilled in the art upon review of the following detailed description, claims and drawings.

BRIEF DESCRIPTION OF THE DRAWINGS

FIG. 1 is a side elevational view of a hand-held power tool embodying the invention.

FIG. 3 is an enlarged view which is taken along line 3—3 in FIG. 1 and which illustrates a vibration isolation module positioned at a joint between a vibration generating tool body and a tool handle.

FIG. 4 is a view taken along 4—4 in FIG. 3.

FIG. 10 is a top plan view of the rear portion of a power tool in accordance with a second embodiment of the invention.

Figure 2:
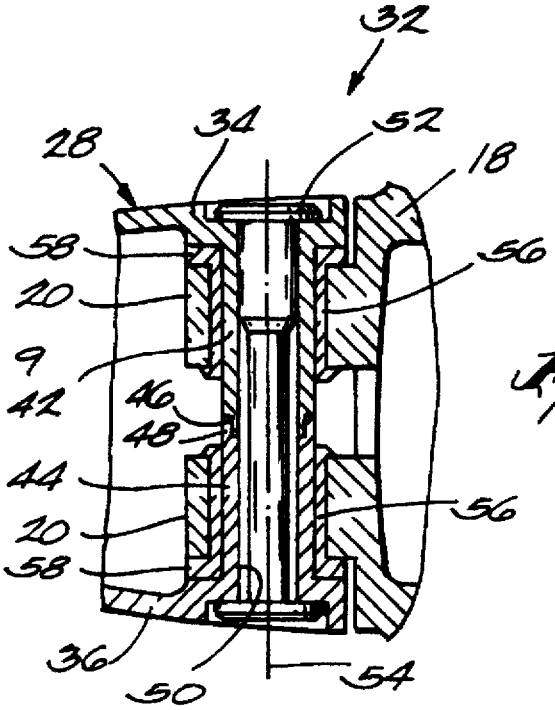
FIG. 2 is an enlarged view taken along line 2—2 in FIG. 1.

Before embodiments of the invention are explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF PREFERRED EMBODIMENTS

Illustrated in FIG. 1 is a hand-held power tool 10 embodying features of the invention. In the particular arrangement shown in the drawings the power tool 10 is a rotary hammer used to drill holes in concrete, masonry, and the like. The rotary hammer 10 includes a tool body 12 adapted to support a tool 14, such as a drill bit, for drilling operations and for combined drilling and hammering operations. The tool body 12 has a longitudinal axis 16 which in the illustrated arrangement is also the tool axis.

As shown in FIG. 1, the tool body 12 includes an outer tool housing 18 which is preferably molded from plastic material. The outer tool housing 18 includes (FIG. 2) a pair of laterally spaced apart ears or rings 20 extending rearwardly from the lower part thereof. The tool body 12 also includes (FIG. 3) an inner tool housing 21 which is substantially encased within the outer tool housing 18 and which is preferably made of a metal alloy material. As shown in FIG. 3, the inner tool housing 21 includes a rear surface 22 having a circular raised portion 24, and a pair of tapped holes 26 on laterally opposite sides of the raised portion 24 extend forwardly from the rear surface 22.

The rotary hammer 10 also includes a main handle 28 which is mounted on the rear end of the tool body 12 at an upper joint 30 and a lower joint 32. While not shown in the illustrated arrangement, the rotary hammer 10 can also be provided with a secondary handle which in one embodiment extends laterally from the tool body 12. The secondary handle provides the tool operator with additional control over the rotary hammer 10 and is a feature known in the art.

The handle 28 includes (FIG. 3) opposite halves 34 and 36 that are secured together with fasteners 37 (only one of which is shown) or other suitable means, and as shown in FIG. 1, the handle 28 is provided with a trigger 38 to control tool operation. In the illustrated arrangement the position of the trigger 38 and the contour of the handle 28 encourage an operator to grip the handle 28 at its upper end so that operator applied pressure is approximately in line with the axis 16. The handle 28 also includes a hand grip portion 40 which, if desired, can be provided with a cushioned gripping sleeve or surface (not shown). The cushioned gripping surface increases operator comfort and to some extent isolates the tool operator from tool vibrations and especially high frequency vibrations such as those caused by the drilling operation of the rotary hammer 10.

As shown in FIG. 2, the handle 28 includes at its lower end a pair of hollow cylindrical members 42 and 44 which extend laterally inwardly from the opposite handle halves 34 and 36 and which have complementary end portions 46 and 48. To form a pivot interface at the lower joint 32, the handle halves 34 and 36 are assembled with the cylindrical members 42 and 44 extending through the rings 20 so that the end portions 46 and 48 engage and the members 42 and 44 form a bore 50. A bolt and nut combination 52 is inserted through the bore 50 and tightened to hold the lower joint 32 together while permitting pivotal movement of the handle 28 relative to the tool body 12 about an axis 54 perpendicular to axis 16.

To insulate the lower part of the handle 28 to at least a limited degree from vibrations and torque reactions, such as can occur when the tool 14 becomes temporarily lodged in a work medium, the lower joint 32 is provided with a pair of elastomeric sleeves 56. As shown in FIG. 2, the sleeves 56 are fitted between the cylindrical members 42 and 44 and the rings 20 and are provided with flanges 58 to prevent lateral contact between the rings 20 and the handle 28. Thus, under all conditions, the sleeves 56 prevent a rigid connection between the handle 28 and the tool body 12 at the lower joint 32.

As shown in FIG. 3, the handle 28 includes at its upper end a second pair of hollow cylindrical members 59 and 60 which extend laterally inwardly from the opposite handle halves 34 and 36 and which are joined by the fastener 37. The upper end of the handle 28 also includes a module support 62 that is fitted between the handle halves 34 and 36 and that forms part of the upper joint 30. The support 62 is preferably made of metallic material and includes a ring member 63 through which the members 59 and 60 extend to hold the support 62 against movement relative to the handle 28 in a direction parallel to axis 16. The support 62 also includes a receptacle portion 64 having a base 65 that is provided with a truncated convex surface portion 66 for reasons more fully explained below. The support 62 is also provided with a pair of slots 66 which are vertically elongated as shown in FIG. 4.

The rotary hammer 10 also includes a primary means for reducing transmission of vibration from the tool body 12 to the handle 28. In the embodiment illustrated in FIGS. 1–9, the primary means for reducing transmission of vibration from the tool body 12 to the handle 28 includes (see FIG. 3) a vibration isolation module 68. As is further explained below, the module 68 is positioned to reduce force transfer from the tool body 12 to the handle 28 in the direction of the axis 16 when operator applied pressure is exerted in a pushing direction (indicated by reference numeral 70).

While the vibration isolation module 68 can have other constructions, in a first embodiment (see FIGS. 5 and 6) the vibration isolation module 68 includes a guide member 72 which is preferably molded of plastic material. The guide member 72 includes a generally cylindrical base 74 that is provided with a channel 76 that is shaped to correspond to the surface portion 66 on the base 65. The guide member 72 also includes a cylindrical guide surface 78 extending from the base 74, a spring seat surface 80, a stop seat surface 82, and a forwardly projecting member 84 having a hole 86.

The vibration isolation module 68 also includes an annular spring housing 88 that is slidable along the guide surface 78 and that includes a spring retainer portion 90. The spring retainer portion 90 has a radially inwardly directed flange 92 which encircles the forwardly projecting member 84. The flange 92 is engageable with the head of a self threading fastener 94 installed in the hole 86 to retain the spring housing 88 on the guide member 72.

The vibration isolation module 68 also includes a spring 96 supported on the spring seat surface 80 and housed in the spring retainer portion 90 of the spring housing 88. As shown in FIG. 6, the spring 96 has an unloaded length and is precompressed (i.e., compressed prior to use as a vibration absorber) to a length which in the illustrated arrangement (see FIG. 5) is a minor fractional portion of its unloaded length. The spring 96, when installed in the vibration isolation module 68, biases the guide member 72 and the spring housing 88 apart.

The aforementioned means for reducing transmission of vibration from the tool body 12 to the handle 28 also includes means for indicating to a tool operator when operator applied pressure on the handle 28 is at a predetermined preferred or recommended level or within a range of recommended levels for optimum tool performance. In the illustrated arrangement, such means is incorporated into the vibration isolation module 68 and tactiley indicates to an operator the level of operator applied pressure, and such means includes an annular snubber or stop member 98. The stop member 98 is seated on the stop seat surface 82 of the guide member 72 in parallel with the spring 96 and encircles the member 84. The stop member 98 acts as a back-up spring to spring 96 and is preferably made of an elastomeric material having a spring rate that is substantially greater than the spring rate of the spring 96 for reasons more fully explained below.

The vibration isolation module 68 is installed in the upper joint 30 and is covered by (FIG. 1) an elastomeric bellows 100. As shown in FIG. 3, the module 68 is positioned so that the spring retainer portion 90 encircles the raised portion 24 and the guide member 72 is received in the receptacle portion 64 of the support 62 with the concave surface portion 76 seated on the convex surface portion 66 of the base 65. That arrangement orients the vibration isolation module 68 in generally parallel relation to axis 16 and allows the module 68 limited pivotal movement about an axis parallel to axis 54. This allows the vibration isolation module 68 to adjust to slight misalignments between the handle 28 and the tool body 12 during tool operation. That arrangement also limits displacement of the module 68 relative to either the handle 28 or the tool body 12 in a direction transverse to axis 16.

In the illustrated arrangement, the vibration isolation module 68 does not resist forces tending to displace the handle 28 relative to the tool body 12 in a pulling direction (indicated by reference numeral 102). Such forces occur, for example, when an operator withdraws the rotary hammer 10 from a work medium. Accordingly, the upper joint 30 is provided with means for limiting relative movement of the handle 28 away from the tool body 12. In the illustrated arrangement, such means includes a pair of fasteners 104 extending through the slots 67 in the handle 28 and threaded into the tapped holes 26 in the inner tool housing 21. The elongated slots 67 permit a limited range of pivotal movement of the handle 28 about the axis 54 of the lower joint 32, and engagement of the fasteners 104 with the handle 28 provides some lateral stability at the upper joint 30. Elastomeric washers 106 are provided on the bolts 104 to soften any impact felt by an operator when the rotary hammer 10 is jerked or otherwise withdrawn from a work medium.

Figure 5:
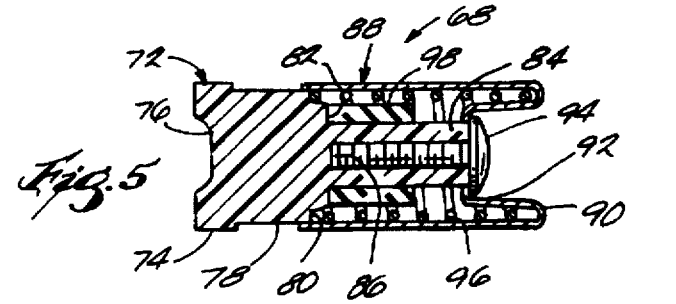
FIG. 5 is a partial cross-sectional view of the vibration isolation module illustrated in FIG. 3 and shown prior to installation in the power tool and rotated ninety degrees relative to its position in FIG. 3.
Figure 6:
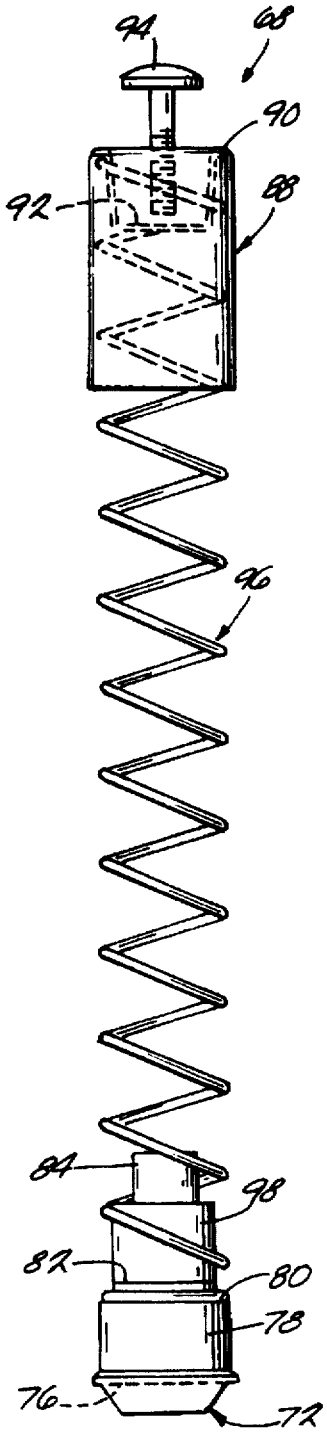
FIG. 6 is a partially exploded view of the vibration isolation module illustrated in FIG. 5.

When the vibration isolation module 68 is installed in the upper joint 30 and the bolts 104 are tightened to the desired setting, the spring 96 is further precompressed (see FIG. 3) from its initially precompressed condition shown in FIG. 5. By further precompressing the spring 96, the guide member 72 and the spring housing 88 are held in firm engagement with the handle 28 and the tool body 12, respectively, and effectively form parts thereof. Thus, relative movement between the tool body 12 and the handle 28 in the direction of axis 16 results in the same relative movement between the housing 88 and the guide member 72, and relative movement of the tool body 12 and the handle 28 toward one another is resisted by the spring 96. The precompressed spring 96 also biases the tool body 12 and the handle 28 apart to prevent looseness or rattling between the handle 28 and the tool body 12.

Figure 7:
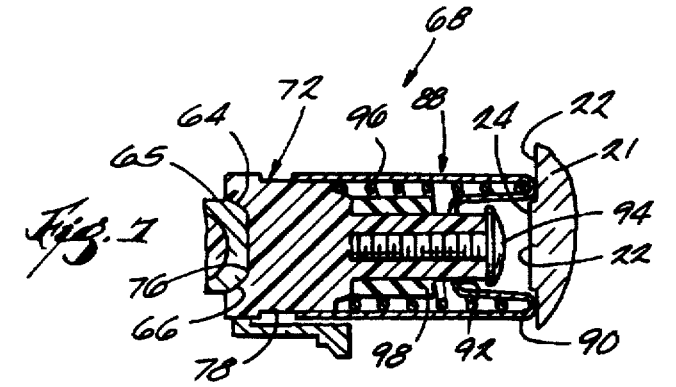
FIG. 7 is a view of a portion of the joint illustrated in FIG. 3 and taken along line 7—7 and shows the deflection of the vibration isolation module when a recommended operator applied pressure level is exerted on the tool handle.
Figure 8:
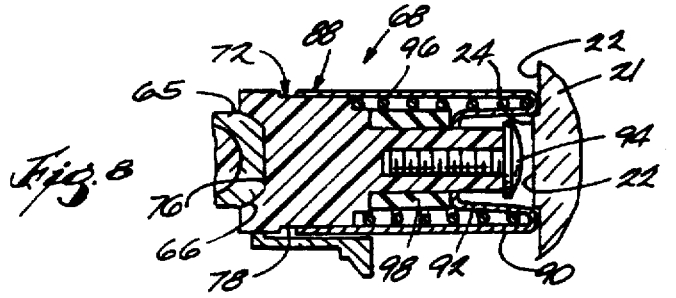
FIG. 8 is a view similar to FIG. 7 and shows the vibration isolation module when a maximum recommended operator applied pressure level is exerted on the tool handle.
Figure 9:
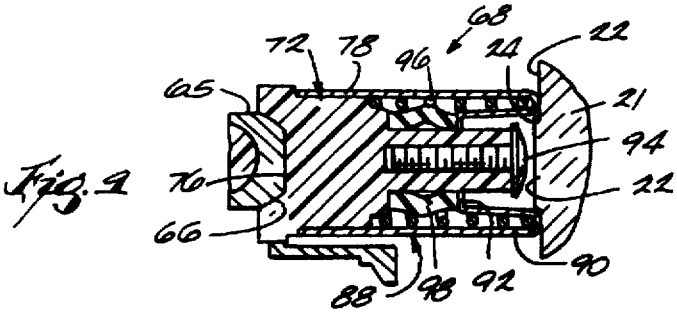
FIG. 9 is a view similar to FIG. 7 and shows the vibration isolation module when an excessive operator applied pressure level is exerted on the tool handle.

In a preferred embodiment, the recommended operator applied pressure to be exerted on the handle 28 for optimum tool performance is represented by a range of pressures including a preferred minimum operator applied pressure level and a preferred maximum operator applied pressure level. The spring 96 is chosen so that the preferred minimum operator applied pressure level is equal to the pressure required to initially deflect the spring 96 from its precompressed condition (FIG. 3) to a further compressed condition (such as shown in FIG. 7). A tool operator can feel this spring deflection when placing pressure on the handle 28 and is thereby given an objective indication that the preferred minimum operator applied pressure is reached or exceeded. The preferred maximum operator applied pressure level is preferably that pressure required to compress the spring 96 to the position shown in FIG. 8 wherein the flange 92 of the spring housing 88 engages the stop member 98. Any further compression of the spring 96 will cause the operator to feel the higher spring rate presented by a combination of the spring 96 and the stop member 98. Within the range of recommended operator applied pressures indicated by the gap 108 in FIG. 3, the spring 96 is capable of absorbing vibrations such as the low frequency vibrations generated by the percussive action of the rotary hammer 10 by compressing and expanding within that range. Thus, the vibration isolation system is designed to provide maximum vibration isolation when the operator exerts a recommended operator applied pressure on the handle 28 because it is at this pressure that tool operation and exposure to vibrations is expected to be prolonged. At higher operator applied pressures, such as when an operator really leans into the rotary hammer 10 to deflect the stop member 98 (FIG. 9), tool operation is expected to be for only brief periods and therefore vibration isolation is not as critical under those conditions.

For example, in one embodiment the rotary hammer 10 has a recommended operator applied pressure on the handle 28 of about 20 $lbs_f$, and the spring 96 is chosen to have a spring rate of about 2 $lbs_f$/inch of spring deflection and an unloaded length of about 12 inches. When installed in a power tool, the spring 96 is precompressed to a length of about 2 inches. To overcome the force exerted by the precompressed spring 96 to initially further compress the spring 96 an operator must apply a force of slightly greater than about 20 $lbs_f$. That further spring deflection provides the operator with a tactile indication that the recommended operator applied pressure has been achieved. Under this condition, oscillation of the spring 96 to absorb vibration is readily permitted until the recommended operator applied pressure is exceeded and the flange 92 of the spring housing 88 bottoms out on the stop member 98. Thus, it is expected that an operator will naturally seek to operate the rotary hammer 10 at the recommended operator applied pressure level on the handle 28 for maximum comfort, especially when tool use is prolonged. In this example, the gap 108 is only about one quarter of an inch and the operator applied pressure on the handle 28 needed to engage the stop member 98 is only about 20.5 $lbs_f$.

Figure 11:
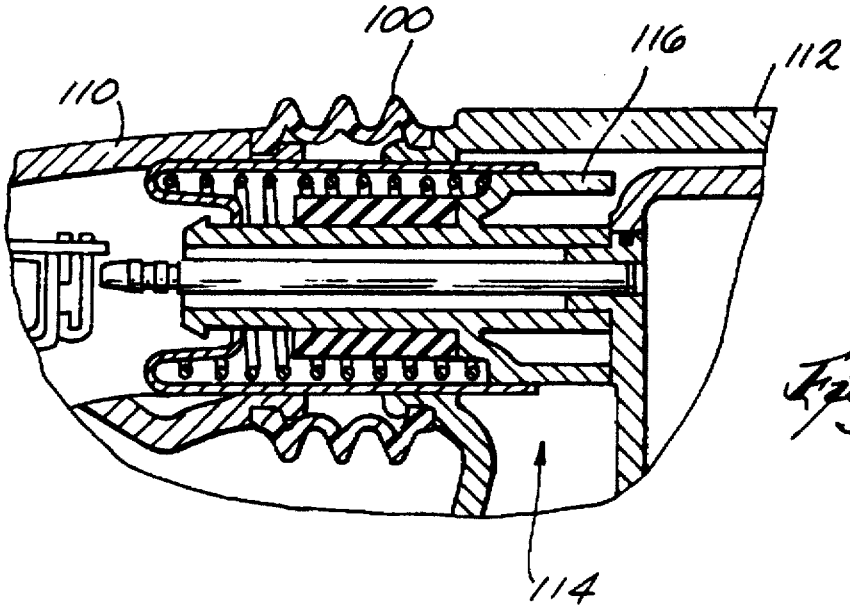
FIG. 11 is an enlarged partial cross-sectional view taken along line 11—11 in FIG. 10 and shows the power tool equipped with a modified vibration isolation module.

Illustrated in FIG. 10 is a portion of a power tool including a modified handle 110 and a modified tool body 112. As shown in FIG. 11, the handle 110 and the tool body 112 are designed to receive a vibration isolation system in accordance with a second embodiment of the invention. In that embodiment the vibration isolation module 68 is replaced with an alternative module 114. Module 114 has a modified guide member 116 which is supported on the tool body 12, instead of the handle 28 as in FIGS. 1–9, and the spring housing 88 is supported against the handle 28. Otherwise, module 114 operates in the same manner as module 68.

While in the illustrated arrangement the vibration isolation system and the mechanism for indicating to a tool operator whether operator applied pressure on the tool handle is within recommended levels form part of a rotary hammer, those features, either alone or in combination, could also be incorporated into other vibratory tools. This will be understood by those skilled in the art after study of the foregoing.

Various features of the invention are set forth in the following claims.

We claim:

1. A hand-held rotary percussive power tool comprising a tool body, a handle mounted on the tool body, and a spring having an unloaded length, the spring being positioned between the tool body and the handle, and the spring being precompressed to bias the tool body and the handle apart, wherein the spring is precompressed to a length which is less than 50% of its unloaded length.

2. A hand-held rotary percussive power tool as set forth in claim 1 wherein the spring is further compressible from its precompressed condition responsive to operator applied pressure on the handle, and wherein the spring is still further compressible to reduce transmission of vibration from the tool body to the handle during tool operation.

3. A hand-held rotary percussive power tool as set forth in claim 1 and further including means for reducing transmission of vibration from the tool body to the handle, the means for reducing transmission of vibration including the spring.

4. A hand-held rotary percussive power tool as set forth in claim 3 and further including a longitudinal axis, an upper joint connecting the handle to the tool body, the upper joint including the means for reducing transmission of vibration from the tool body to the handle, the means for reducing transmission of vibration from the tool body to the handle damping relative movement of the tool body toward the handle in the direction of the longitudinal axis, and the upper joint including means for limiting relative movement of the handle away from the tool body in the direction of the longitudinal axis, and wherein the power tool further includes a lower joint connecting the handle to the tool body, the lower joint permitting pivotal movement of the handle relative to the tool body about an axis perpendicular to the longitudinal axis.

5. A hand-held rotary percussive power tool as set forth in claim 1 wherein the power tool has a predetermined preferred range of operator applied pressure levels on the handle for normal power tool operation, and wherein the power tool includes means for indicating to a tool operator when operator applied pressure on the handle is within the predetermined preferred range of operator applied pressure levels, the means for indicating to a tool operator when operator applied pressure on the handle is within the predetermined preferred range of operator applied pressure levels including the spring.

6. A hand-held rotary percussive power tool as set forth in claim 5 wherein the preferred range of operator applied pressure levels includes a preferred minimum operator applied pressure level, the preferred minimum operator applied pressure level being that operator applied pressure level sufficient to deflect the spring from its precompressed condition to a further compressed condition, wherein deflection of the spring to its further compressed condition indicates to an operator that the preferred minimum operator applied pressure level is reached, and a preferred maximum operator applied pressure level, and wherein the means for indicating to a tool operator when operator applied pressure on the handle is within the predetermined preferred range of operator applied pressure levels includes a stop, the stop being engageable simultaneously with both the tool body and the handle to inhibit further compression of the spring to indicate to an operator that the preferred maximum operator applied pressure level has been reached.

7. A hand-held rotary percussive power tool as set forth in claim 6 wherein the spring has a spring constant, and the stop has a spring constant that is greater than the spring constant of the spring.

8. A hand-held rotary percussive power tool as set forth in claim 1 wherein, when a predetermined minimum preferred operator applied pressure level is exerted on the handle, the spring deflects from its precompressed condition, and wherein the power tool further includes a tool axis, a first member supported on the tool body for movement therewith in the direction of the tool axis, a second member supported on the handle for movement therewith in the direction of the tool axis, the spring being positioned between the first and second members to resist relative movement of the tool body toward the handle in the direction of the tool axis, and a stop member, the stop member engaging one of the first member and the second member, and the stop member being engageable with the other of the first member and the second member to restrict movement of the first member toward the second member when an operator applied pressure on the handle reaches a predetermined preferred maximum operator applied pressure level.

9. A hand-held rotary percussive power tool as set forth in claim 8 wherein the first member is supported on the tool body for movement relative thereto in a direction transverse to the tool axis, and wherein the second member is supported on the handle for pivotal movement relative thereto.

10. A power tool comprising a tool body, a handle supported on the tool body and movable relative to the tool body between a resting first position and fully compressed second position, and a spring mounted between the tool body and the handle, the spring being prestressed to create a spring force that biases the handle toward the first position, wherein movement of the handle from the first position to the second position corresponds with a change in the spring force from a first force to a second force, the first force being at least 50% of the second force.

11. A power tool as set forth in claim 10 wherein the spring has an unloaded length, and wherein the spring is precompressed to a minor fractional portion of its unloaded length.

12. A power tool as set forth in claim 10 and further including means for reducing transmission of vibration from the tool body to the handle, the means for reducing transmission of vibration including the spring.

13. A power tool as set forth in claim 12 and further including a longitudinal axis, an upper joint connecting the handle to the tool body, the upper joint including the means for reducing transmission of vibration from the tool body to the handle, the means for reducing transmission of vibration from the tool body to the handle damping relative movement of the tool body toward the handle in the direction of the longitudinal axis, and the upper joint including means for limiting relative movement of the handle away from the tool body in the direction of the longitudinal axis, and wherein the power tool further includes a lower joint connecting the handle to the tool body, the lower joint permitting pivotal movement of the handle relative to the tool body about an axis perpendicular to the longitudinal axis.

14. A power tool as set forth in claim 10 wherein the power tool has a predetermined preferred range of operator applied pressure levels on the handle for power tool operation, and wherein the power tool includes means for tactiley indicating to a tool operator when operator applied pressure on the handle is within the predetermined preferred range of operator applied pressure levels, the means for tactiley indicating to a tool operator when operator applied pressure on the handle is within the predetermined preferred range of operator applied pressure levels including the spring.

15. A power tool as set forth in claim 14 wherein the preferred range of operator applied pressure levels includes a preferred minimum operator applied pressure level, the preferred minimum operator applied pressure level being that operator applied pressure level sufficient to initially deflect the spring from its precompressed condition to a further compressed condition, wherein initial deflection of the spring from its precompressed condition indicates to an operator that the preferred minimum operator applied pressure level is reached, and a preferred maximum operator applied pressure level, and wherein the means for tactiley indicating to a tool operator when operator applied pressure on the handle is within the predetermined preferred range of operator applied pressure levels includes a stop member, the stop member being engageable simultaneously with both the tool body and the handle to inhibit further compression of the spring to indicate to an operator that the preferred maximum operator applied pressure level has been reached.

16. A power tool as set forth in claim 14 and further including a longitudinal axis, wherein the means for tactiley indicating to a tool operator when operator applied pressure on the handle is within the predetermined preferred range of operator applied pressure levels includes a housing, and a guide member, the spring being supported on the guide member and housed in the housing, and the spring biasing one of the housing and the guide member into engagement with the tool body and the spring biasing the other of the housing and guide member into engagement with the handle so that relative movement between the tool body and the handle in the direction of the longitudinal axis results in relative movement between the housing and the guide member in the direction of the longitudinal axis.

17. A power tool as set forth in claim 16 wherein the means for tactiley indicating to a tool operator when operator applied pressure on the handle is within the predetermined preferred range of operator applied pressure levels includes a stop member, the stop member being supported on the guide member, and the stop member being engageable by the housing to restrict movement of the housing toward the guide member when an operator applied pressure on the handle reaches a predetermined preferred maximum operator applied pressure level.

18. A power tool as set forth in claim 10 wherein the first force is at least 75% of the second force.

19. A power tool as set forth in claim 10 wherein the first force is at least 90% of the second force.

20. A vibratory tool comprising a tool body, a handle mounted on the tool body, the vibratory tool having a predetermined preferred range of operator applied pressure levels on the handle for tool operation, the preferred range of operator applied pressure levels including a preferred minimum operator applied pressure level, and a preferred maximum operator applied pressure level, and means for tactiley indicating to a tool operator when operator applied pressure on the handle is within the preferred range of operator applied pressure levels, the means for tactiley indicating to a tool operator when operator applied pressure on the handle is within the preferred range of operator applied pressure levels including a spring positioned between the tool body and the handle, the spring having a spring rate of less than 6 pounds per inch.

21. A vibratory tool as set forth in claim 20 wherein the spring is precompressed to bias the tool body and the handle apart, wherein the spring is further compressible from its precompressed condition responsive to operator applied pressure on the handle, and wherein the preferred minimum operator applied pressure level is that operator applied pressure level sufficient to initially deflect the spring from its precompressed condition.

22. A vibratory tool as set forth in claim 21 wherein the means for tactiley indicating to a tool operator when operator applied pressure on the handle is within the preferred range of operator applied pressure levels includes a stop, the stop being positioned between the tool body and the handle to inhibit further compression of the spring when operator applied pressure on the handle reaches the preferred maximum operator applied pressure level.

23. A vibratory tool as set forth in claim 22 wherein the spring has a spring constant, and the stop has a spring constant that is greater than the spring constant of the spring.

24. A vibratory tool as set forth in claim 22 and further including a longitudinal axis, wherein the means for tactiley indicating to a tool operator when operator applied pressure on the handle is within the predetermined preferred range of operator applied pressure levels includes a housing, and a guide member, the spring being supported on the guide member and housed in the housing, and the spring biasing one of the housing and the guide member into engagement with the tool body and the spring biasing the other of the housing and guide member into engagement with the handle so that relative movement between the tool body and the handle in the direction of the longitudinal axis results in relative movement between the housing and the guide member in the direction of the longitudinal axis.

25. A vibratory tool as set forth in claim 20 wherein the spring is precompressed to bias the tool body and the handle apart, wherein the spring is further compressible from its precompressed condition responsive to operator applied pressure on the handle, and wherein the spring is still further compressible to reduce transmission of vibration from the tool body to the handle during tool operation.

26. A vibratory tool as set forth in claim 25 wherein the spring has an unloaded length, and wherein the spring is precompressed to a minor fractional portion of its unloaded length.

27. A hand-held rotary percussive power tool as set forth in claim 1 wherein the spring is precompressed to less than 25% of its unloaded length.

28. A vibratory tool as set forth in claim 20 wherein the spring has a spring rate of less than 4 pounds per inch.

29. A vibratory tool as set forth in claim 20 wherein the spring has a spring rate of about 2 pounds per inch.

* * * * *